US005779559A

United States Patent [19]

Eberle

[11] Patent Number: 5,779,559

[45] Date of Patent: Jul. 14, 1998

[54] GOLF CLUB WITH IMPROVED GRIP

[76] Inventor: George F. Eberle, P.O. Box 1588, Boca Grande, Fla. 33921

[21] Appl. No.: 788,021

[22] Filed: Jan. 24, 1997

[51] Int. Cl.[6] ..... A63B 53/14

[52] U.S. Cl. ..... 473/294; 473/303; 473/252

[58] Field of Search ..... 473/300, 301, 473/302, 303, 200, 201, 202, 203, 204, 549, 559, 568, 294, 252

[56] References Cited

U.S. PATENT DOCUMENTS

| | | | |
|---|---|---|---|
| 1,506,523 | 8/1924 | Gordon | 473/201 |
| 3,679,207 | 7/1972 | Florian | 473/294 |
| 4,116,440 | 9/1978 | Takeshima | 473/203 |
| 4,215,860 | 8/1980 | Nakamatsu | 473/201 |
| 4,310,158 | 1/1982 | Hoffman | 473/204 |
| 4,537,403 | 8/1985 | Farina | 473/203 |
| 4,629,191 | 12/1986 | Mancuso | 473/203 |
| 4,679,791 | 7/1987 | Hull | 473/201 |
| 4,746,120 | 5/1988 | Mockovak | 473/201 |
| 4,795,158 | 1/1989 | Kuykendall | 473/201 |
| 5,419,747 | 5/1995 | Ciamaga | 473/300 |
| 5,478,074 | 12/1995 | Storper | 473/302 |

*Primary Examiner*—Sebastiano Passaniti

*Attorney, Agent, or Firm*—Polster, Lieder, Woodruff & Lucchesi, L.C.

[57] ABSTRACT

A pendulum-type putter has a grip provided with two flats that lie perpendicular to the plane of the face on the head of the putter. The golfer holds the grip with the fingers and thumb of one hand along the flats to establish a steady pivot about which the putter swings during a putt. The grip along the bore that receives the shaft of the club may have ribs to facilitate installation of the grip over the shaft.

11 Claims, 2 Drawing Sheets

GOLF CLUB WITH IMPROVED GRIP

BACKGROUND OF THE INVENTION

This invention relates in general to golf clubs and more particularly to a putter having an improved grip and to a grip securement.

Pendulum-type putters have gained favor among some golfers in that they are easier to steady and control, enabling golfers to avoid abrupt movements that send putts off course or with too little or too much velocity. Basically, the typical pendulum type putter has an extended shaft with one or two grips at its upper region and a head at its lower end. Where a single grip is present, the grip is somewhat longer than the grip of a more conventional stroke-type putter. Where two grips are present, they are individually somewhat shorter in length, but they lie along essentially the same region of the extended shaft. Irrespective of whether one or two grips exist, the object is to provide enough gripping surface to enable the golfer to grip the putter with his hands spread somewhat apart. In this regard, the golfer holds the upper end of the single grip or the upper grip where two grips exist with one hand and then steadies that hand against his chest or chin. With the other hand the golfer grasps the lower portion of the single grip or lower grip where two are employed and withdraws the shaft, moving the head away from the ball in an arc. Once the head is withdrawn an appropriate distance, the golfer, using the same hand, moves the shaft forwardly, causing the head to accelerate and strike the ball, thus propelling it forwardly. All the while, the upper hand remains steady, it bearing against the user's chest or chin and while it serves as a pivot, it does not otherwise contribute to the motion of the putter head.

The grip of a stroke-type putter, on the other hand, is grasped with both hands, much like any of the other clubs, that is with both hands adjacent or partially overlapping each other. The golfer must rely on only his hands to steady the putter and impart movement to it. Some golfers have the tendency to jerk the putter and this leads to errant putts.

According to the Rules of Golf published by the United States Golf Association, a putter, in contrast to other clubs, may have a grip that is noncircular in cross-section, but the grip must be symmetrical, must remain similar throughout its length, and must not have concavity. A putter may also have more than one grip, provided each is circular in cross-section and has its axis coincident with the axis of the shaft.

Apart from the difficulties of putting, the installation of a grip over the upper end of a club shaft requires considerable force. In this regard, one seeking to install a new grip on a club must first remove the old grip, and tools are available to accomplish that. Next any debris on the upper end of the club shaft is removed, and this region of the shaft is wrapped with a double-sided tape, that is tape having adhesive on both of its faces. Next a solution is applied to the tape to deactivate the adhesive on its outwardly presented face and indeed make it somewhat fluid so that it serves more as lubricant than an adhesive. A new grip is then forced over the upper region of the shaft and oriented correctly with respect to the head. Notwithstanding the fluent character of the adhesive, the new grip does not advance easily over the tape. Indeed, considerable force is required. Once the new grip is in place, the adhesive again becomes tacky and firmly holds the grip in place.

BRIEF SUMMARY OF THE INVENTION

The present invention resides in a putter having a shaft and a single grip on the shaft. The grip has at least two generally parallel flats which enable the user to more easily hold the grip and establish a steady pivot about which the putter swings during an actual putt. The invention also resides in a club having a grip provided with ribs or serrations in the bore that receives the shaft of the club to facilitate installation of the grip on the shaft. The invention also consists in the parts and in the arrangements and combinations of parts hereinafter described and claimed.

BRIEF DESCRIPTION OF THE SEVERAL VIEWS OF THE DRAWINGS

In the accompanying drawings which form part of the specification and wherein like numerals and letters refer to like parts wherever they occur.

DETAILED DESCRIPTION

Figure 2:
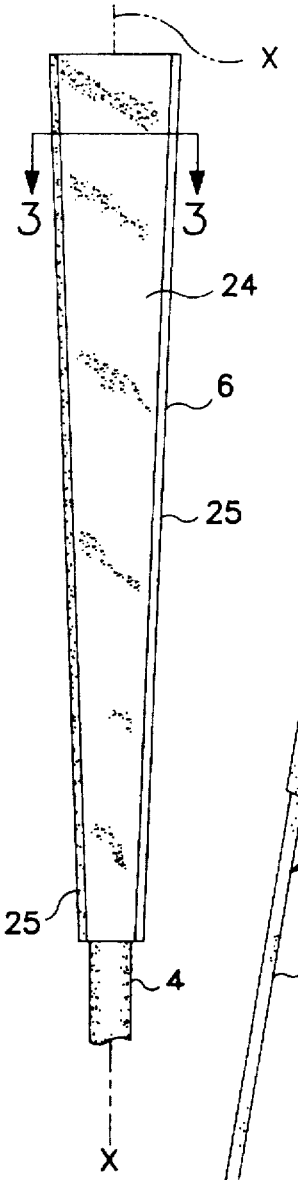
FIG. 2 is a plan view of the tapered grip and the upper region of the shaft.

Referring now to the drawings, a putter A (FIG. 1) includes a head 2, a shaft 4, and a grip 6. The head 2 is attached to one end of the shaft 4, whereas the grip 6 fits around the shaft 4 at its opposite end. A golfer, of course, holds the putter A along the grip 6 and swings it such that its head 2 strikes a golf ball, thus propelling the ball over a green.

The head 2 has (FIG. 1) a face 8 and a sole 10 at the bottom of the face 8. The face 8, which is flat, is presented forwardly and represents the surface along which the head 2 actually strikes a golf ball. The sole 10 forms the bottom of the head 2 and is generally flat or slightly convex, but is perpendicular to the face 8. The face 8 lies between a heel 12 and a toe 14 on the head 2.

Figure 1:
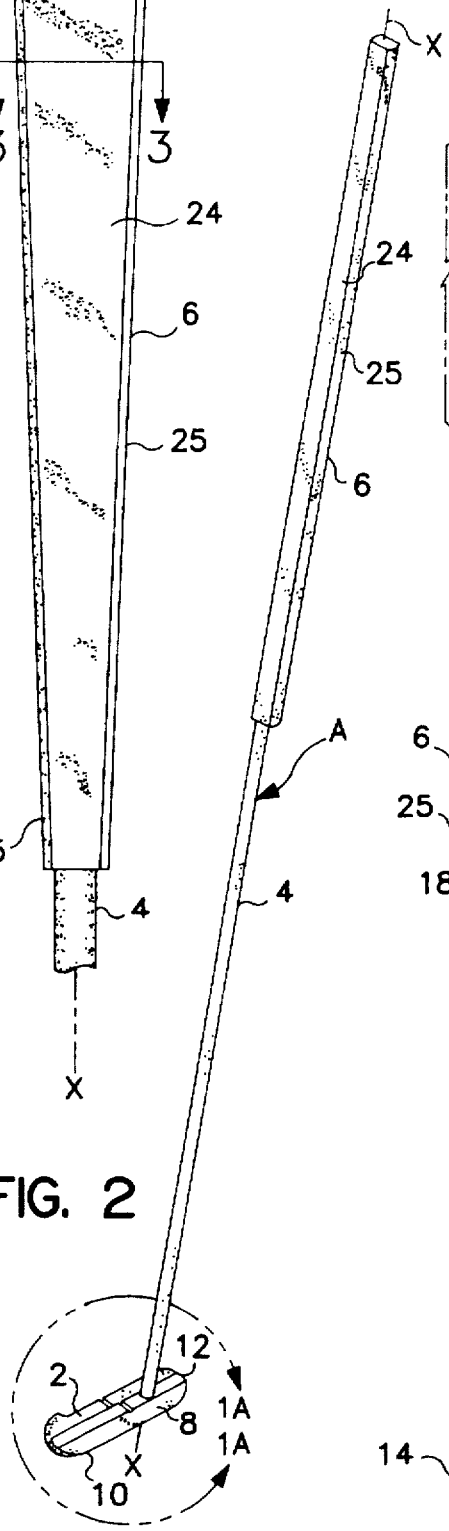
FIG. 1 is a perspective view of a putter provided with a tapered grip constructed in accordance with and embodying the present invention.

The shaft 4 is attached to the head 2 and extends upwardly from it. Except perhaps for the region of the attachment, it is perfectly straight, and as such has a longitudinal axis X (FIG. 1). The included angle between the axis X and the generally flat sole 10 on the head 2 should not exceed 80°. The grip 6 fits around the upper regions of the shaft 4, and here the shaft 4 is truly straight. The length of the shaft 4 is such that it presents the grip 6 in the region of the user's chest, and as such the putter A is somewhat longer than more traditional stroke-type putters. Generally speaking, the distance between the sole 10 of the head 2 and the upper end of the grip 6 should be at least 37 inches and should preferably range between 40 and 54 inches.

Figure 3:
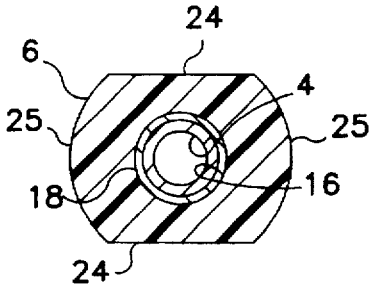
FIG. 3 is a sectional view taken along line 3—3 of FIG. 2.
Figure 1A:
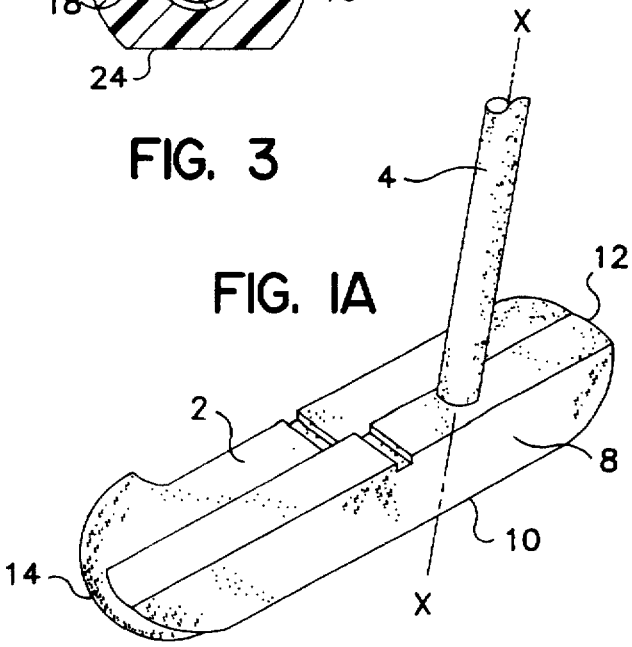
FIG. 1A is an enlarged view of the putter head shown in FIG. 1.

The grip 6 fits over the upper region of the shaft 4 and possesses radial symmetry about the axis X of the shaft 4 (FIG. 3). It is preferably molded from an elastomer or some other material which is somewhat resilient, yet stiff enough to retain its shape when a golfer grips it, even with considerable force. The grip 6 has a bore 16 which opens out of its lower end, but is closed at the upper end, except for perhaps a small hole. The bore 16 is large enough to receive the upper end of the shaft 4, although quite snugly. Actually the grip 6 does not fit directly over the wall of the shaft 4, but instead over a tape 18 (FIG. 3) that is first wrapped around the upper region of the shaft 4. The tape 18 has adhesive on both of its surfaces. The adhesive on the inner surface bonds the tape 18 to the shaft 4, whereas the adhesive on the outer surface bonds to the grip 6 at the surface of the bore 16 in the grip 6.

In order to install the grip 6 on the shaft 4, the tape 18 is first wrapped around the upper region of the shaft 4 and, of course, the adhesive on it bonds the tape 18 to the shaft 4. Next a solution is applied to the tape to deactivate the adhesive on the outer surface of the tape 18 and indeed render that adhesive somewhat viscous and slick. The grip 6 slides with some resistance over the deactivated adhesive. Within a short time the adhesive regains its capacity to adhere and bonds firmly to the grip 6 along the surface of the bore 16, thus securing the grip 6 firmly around the shaft 4.

Figure 9:
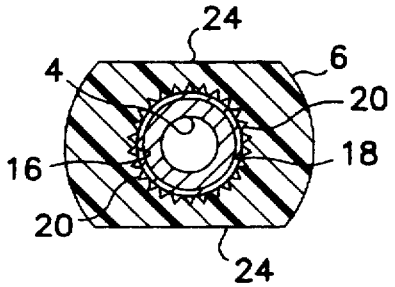
FIG. 9 is a sectional view of the grip with ribs along its bore to facilitate installation over a club shaft.

To facilitate installation of the grip 6 over the tape 18 on the shaft 4, the grip 6 may be provided with ribs 20 (FIG. 9) along the surface of the bore 16. In the flutes between the ribs 20, the diameter of the bore 16 is enlarged somewhat—indeed perhaps 0.02 to 0.06 inches greater than the diameter of the tape 18 that is wound around the shaft 4. However, at the inner surfaces of the ribs 20, the diameter of the bore 16, before the grip 6 is installed on the shaft 4, is slightly less than the diameter of the tape 18 that is wound around the shaft—indeed, by perhaps 0.01 to 0.10 inches. When the grip 6 with the ribs 20 is forced over the tape 18 on the shaft 4, the ribs 20 deform into the adjacent flutes and slide over the deactivated adhesive on the tape 18. This requires considerably less force than that required to install traditional grips with smooth surface bores.

Figure 4:
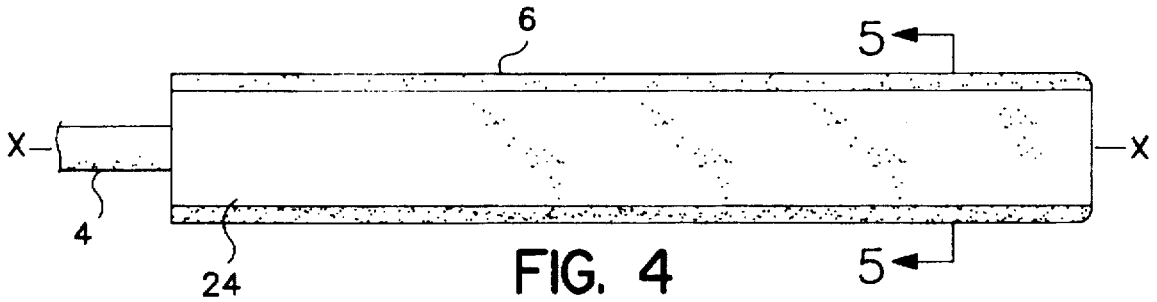
FIG. 4 is a plan view of a straight grip (without taper) constructed in accordance with the present invention.

The grip 6 should be at least 12 inches long and preferably 14 to 24 inches long. To a measure, its length depends on the length of the shaft 4 and that length depends on the height of the golfer and how he uses the putter A. The grip 6 may have a slight taper (FIG. 2), with its region of greatest cross-section being at the upper end of the shaft 4, or it may have generally uniform cross-section throughout its length (FIG. 4). Its largest cross-sectional dimension should not exceed 1.75 inches.

Figure 5:
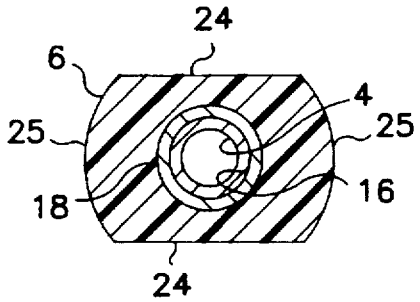
FIG. 5 is a sectional view taken along line 5—5 of FIG. 4.

The radial symmetry of the grip 6 exists in the absence of circularity. Indeed, the grip 6 on its external surface least two flats 24 and two arcuate surfaces 25 which lie between the flats 24 (FIGS. 3 and 5). The flats 24, which face in opposite directions, lie in planes that are perpendicular to the flat face 8 on the head 2. Thus, one flat 24 is presented in the direction of the toe 14 on the head 2 (FIG. 1), while the other is presented in the direction of the heel 12 on the head 2. Looking down the former, the golfer sees the top of the head 2.

Figure 6:
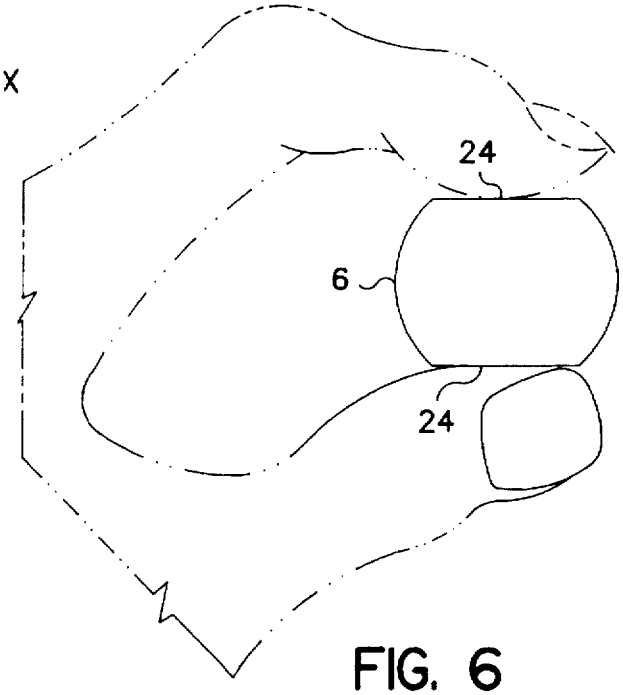
FIG. 6 is an end view of the upper end of the grip held between the fingers and thumb of a hand to form a pivot.

Using the putter A with the grip 6, the golfer holds the grip 6 near its upper end with the fingers of the left hand along the flat 24 that is presented in the direction of the toe 14 and with the thumb of that hand along opposite flat 24 (FIG. 6). Standing to the side of the ball with his feet generally perpendicular to the direction of the contemplated putt, the golfer steadies his left hand against his chest, or perhaps against his chin, with the head of the club immediately behind the ball and of course the face 8 of the head 2 presented toward the ball. Then, with the right hand, the golfer grasps the grip 6 somewhat lower and draws the shaft 4 backwardly. The head 2 retracts from the ball, while the grip 6 pivots between the thumb and the fingers that are against the flats 24. Since the left hand is against the golfer's chest or chin, it remains generally fixed—or steadied. The golfer then moves the shaft 4 forwardly. Again the upper end of the grip 6 pivots between the thumb and fingers without otherwise changing position—owing to the steadying effect of the left hand against the chest or chin. The head 2 moves forwardly and along its face 8 strikes the ball and propels the ball over the green. Since the upper end of the shaft 4 is stabilized by the left hand and merely pivots, the tendency to jerk the putter and produce an errant putt is reduced. Thus, the putter A enables some golfers to putt with greater precision.

Using essentially the same hand placements, the golfer can also putt the ball while facing in the direction of the intended putt. In this instance the left forearm comes across the golfer's chest to stabilize the left hand, which is to the golfer's right side, with the fingers and thumb being directed rearwardly over the flats 24 to create a pivot at the upper end of the grip 6. Again the right hand withdraws the shaft 4 and along with it the head 2. Then the right hand moves the head 2 forwardly in the direction that the golfer's feet are extended. The head 2 at its face 8 strikes the ball, driving it forwardly. Since the golfer's chest stabilizes the golfer's left hand, the tendency to jerk the putter A is reduced.

Figure 7:
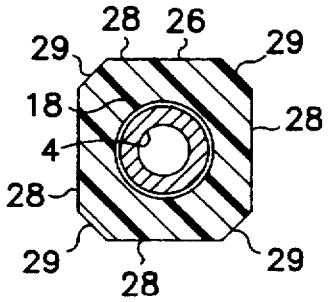
FIG. 7 is a sectional view of a modified grip with a rectangular cross section.

A modified grip 26 (FIG. 7) likewise fits over the upper end of the shaft 4, but instead of having two flats 24, it has four flats 28 arranged at right angles with respect to each other and connected at beveled corners 29. This imparts a rectangular cross-section to the grip 6. Two of the flats 28 lie perpendicular to the plane of the face 8 on the head 2, whereas the other two lie generally parallel to the face 8. The fingers and thumb of the golfer's left hand hold the grip 26 along the flats 28 that lie perpendicular and thereby establish a pivot. The fingers and thumb of the right hand holds the grip 6 along those flats 28 which the golfer deems most suited to his style. Using his right hand, the golfer withdraws the shaft 6 and then moves it forwardly, bringing the head 2 against the ball.

Figure 8:
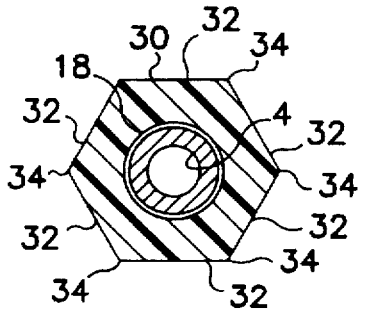
FIG. 8 is a sectional view of another modified grip with a hexagonal cross section.

Another modified grip 30 (FIG. 8) has six flats 32 joined at edges 34, thus imparting a hexagonal cross-sectional configuration to the grip 30. Two of the flats 32 lie perpendicular to the plane of the face 8 on the head 2, and along these flats 32 the golfer holds the grip 30 at its upper end to create a pivot, all in the manner previously described. The remaining flats 32 provide surfaces for grasping the grip 30 with the right hand to swing the shaft 4 rearwardly and then move it forwardly.

The flats of any of the grips 6, 26, 30 need not be symmetrical about the axis X of the shaft 4, but instead may be symmetrical about an axis that is offset from, yet parallel to, the axis X. The putter A illustrated in the drawings is configured for use by a right-handed golfer, and of course the discussion pertaining to the use of the putter A likewise pertains to a right-handed golfer. For a left-handed golfer the reverse would apply.

This invention is intended to cover all changes and modifications of the example of the invention herein chosen for purposes of the disclosure which do not constitute departures from the spirit and scope of the invention.

What is claimed is:

1. An extended length putter comprising: a shaft having a longitudinal axis; a head attached to one end of the shaft and having a sole that is presented downwardly and a generally flat face that rises generally vertically from the sole to serve as the surface along which the head contacts a golf ball; and a grip located around the shaft in the region of its other end, the grip having two flats which extend along its opposite sides and lie substantially perpendicular to the plane in which the face of the head lies, the grip being at least 14 inches long and the distance between the top of the grip and the sole of the head being at least 40 inches, whereby the grip along its flats may be held between the fingers and thumb of a hand to establish a pivot about which the putter swings during a putting stroke.

2. A putter according to claim 1 wherein the grip is radially symmetrical with the axis of radial symmetry coinciding with longitudinal axis of the shaft.

3. A putter according to claim 1 wherein the grip has additional flats arranged at angles with respect to the two flats along which the pivot is established.

4. A putter according to claim 3 wherein the flats impart a polygonal cross-sectional configuration to the grip.

5. A putter according to claim 3 wherein the flats impart a rectangular cross-sectional configuration to the grip.

6. A putter according to claim 3 wherein the flats impart a hexagonal cross-sectional configuration to the grip.

7. A putter according to claim 1 wherein the two flats lie substantially parallel to each other.

8. A putter according to claim 1 wherein the flats taper slightly and are farthest apart at the end of the grip that lies farthest from the head.

9. A putter according to claim 1 wherein the grip is radially symmetrical and the axis of radial symmetry is offset from the axis of the shaft.

10. A golf club comprising a shaft; a head attached at one end of the shaft and providing a surface along which the club strikes a golf ball; tape wound around the shaft in the region of the opposite end of the shaft and having an adhesive for securing it to the shaft and for providing an adherent outwardly presented surface; and a grip formed from a resilient material and having a bore which receives the other end of the shaft around which the tape is wrapped, the grip having axially directed ribs along its bore and flutes separating the ribs, the grip contacting the adherent surface of the tape along the ribs with the ribs being deformed against the adherent surface.

11. A golf club according to claim 10 wherein the ribs are deformed into the flutes which separate them.

* * * * *